US005941406A

United States Patent [19]

Przytulla

[11] Patent Number: 5,941,406

[45] Date of Patent: Aug. 24, 1999

[54] LIDDED BARREL WITH BARREL LID AND CLAMPING-RING CLOSURE

[75] Inventor: Dietmar Przytulla, Kerpen, Germany

[73] Assignee: Mauser-Werke GmbH, Germany

[21] Appl. No.: 08/889,568

[22] Filed: Jul. 8, 1997

[30] Foreign Application Priority Data

Jul. 19, 1996 [DE] Germany ..... 296 12 506 U

[51] Int. Cl.[6] ..... B65D 51/18

[52] U.S. Cl. ..... 220/254; 220/321; 220/601

[58] Field of Search ..... 220/254, 320, 220/321, 601

[56] References Cited

U.S. PATENT DOCUMENTS

| | | | |
|---|---|---|---|
| 4,674,648 | 6/1987 | Przytulla | 220/601 |
| 4,736,862 | 4/1988 | Hammes et al. | 220/601 |
| 4,776,479 | 10/1988 | Schutz | 220/601 X |
| 5,014,873 | 5/1991 | Clemens et al. | 220/601 |
| 5,217,142 | 6/1993 | Schutz | 220/601 |
| 5,273,181 | 12/1993 | Gay | 220/601 |
| 5,568,876 | 10/1996 | Schutz | 220/254 |
| 5,593,060 | 1/1997 | Przytulla | 220/319 |

FOREIGN PATENT DOCUMENTS

| | | |
|---|---|---|
| 2708914 | 2/1995 | France . |
| 42 36 338 | 5/1994 | Germany . |
| 296 12 506 U1 | 9/1996 | Germany . |
| W0 96/08416 | 3/1996 | WIPO . |

*Primary Examiner*—Stephen K. Cronin
*Attorney, Agent, or Firm*—Pennie & Edmonds LLP

[57] ABSTRACT

The object of this invention is a lidded barrel with a barrel lid and a clamping-ring closure. Between its flat lid plate and its outer rim, the barrel lid is provided with a circular, perimetric groove while also featuring in its periphery at least one bung well with or without a bunghole. When a barrel is dropped, the areas around the bung well are most vulnerable to breakage, i.e. it is in these areas that the barrel lid is most likely to slip out of the clamping ring with leaks resulting. In order to improve leak resistance of a lidded barrel, especially one suitable and approved for hazardous liquids, under extreme stress-load conditions, the area around the bung wells of the barrel lid is to be stress-relieved in the event of overstress (dropped barrel). According to the present invention, this is to be accomplished by making and incorporating between the recessed bung well and the upper edge of the outer, inverted-U-shaped rim of the barrel lid suitable provisions whereby the radial surface length—as measured from the center of the lid to the upper edge of the U-shaped rim—of this area or segment of the barrel lid are elongated in relation to the neighboring areas or segments of the barrel lid away from the bung well.

25 Claims, 8 Drawing Sheets

——— NORMAL SHAPE
- - - - - DEFORMED SHAPE

——— NORMAL SHAPE
- - - - - DEFORMED SHAPE

LIDDED BARREL WITH BARREL LID AND CLAMPING-RING CLOSURE

BACKGROUND OF THE INVENTION

The object of this invention is a lidded barrel for the storage and transportation especially of hazardous bulk materials in particulate, paste or liquid form, consisting of a cylindrical or cone-shaped lidded barrel body with an upper, radially asymmetrical barrel lid and a U-shaped clamping-ring closure which in the area of the upper barrel opening hooks under a flanged rim provided on the outer barrel wall while gripping the outer U-shaped rim of the barrel lid and, when in the closed position, pressing it against the barrel opening for a closure impermeable to gas and liquids, the barrel lid featuring between its flat top and its outer rim a circular groove (e.g. a groove for the grippers of barrel hoists) and at least one peripherally located, recessed bung well (i.e. bung enclosure) including, as the case may be, a bunghole with gas-tight and impermeable stopcap.

This invention is based on the realization that with this type of radially asymmetric barrel lid peripherally provided with at least one bung well and, as the case may be, a bunghole incorporated therein (for instance a 2" filling/draining bunghole on one side and/or a ¾" venting/bunghole in the opposite peripheral area), the adjoining areas around the bung well or the transitions between the normal barrel-lid top level and the bung well are most vulnerable to impact, i.e. breakage-prone in the event the barrel is dropped and are the most likely to develop material overstress with attendant cracks and leaks. The same is true for barrel lids which are provided with bung wells but not with bungholes and fittings or spouts.

In cases of extreme stress such as internal-pressure tests, diagonal or lateral (side-wall) drop tests involving a barrel lid attached to a corresponding lidded barrel by means of a clamping ring, local overstress in the areas most strongly dented and thus most exposed to tensile stress plus substantial superimposed bending stress will cause these areas to be the first where the rim of the lid slips out of the upper part of the clamping ring, rendering the lidded barrel leaky. Especially barrel lids made of a thermoplastic material (hard plastic) will often crack and break in these areas even though they remain attached to the rim of the barrel body. The areas of the barrel lid which include the peripheral, recessed bung wells (perhaps even with a raised spout) are usually more rigid and inelastic than regular peripheral areas of barrel lids not containing bung wells.

A very significant reason for the breakage and cracking in the immediate area of the recessed bung well, addressed in this invention, is the presence in such radially asymmetric barrel lids of differentiated radial extensions or surface lengths. The radial extensions are measured from the center point of the lid to the upper, horizontally level edge of the outer inverted U-shaped rim of the lid that opens up toward the bottom. It is in these very recessed bung wells that the radial extensions are relatively shorter. This is true even more so in the case of barrel lids with a second circular corrugation which is interrupted by the bung enclosure. When there is an increased internal pressure, for instance in an internal-pressure test, shorter radial extensions in the area of the bung well will expose this area to greater stress (ovalization) and may cause a leak. The barrel lids as well as the lidded barrel bodies may consist of a thermoplastic material and/or metal (sheet iron).

SUMMARY OF THE INVENTION

It is the objective of this invention to overcome these shortcomings of the current state of the art, improving the integrity in extreme stress situations especially of a lidded-barrel design suitable, approved and used for hazardous liquid materials. This is to be accomplished by relieving the stress in the area around the bung well of the barrel lid.

According to this invention, the problem is solved by means of an appropriate provision and configuration between the recessed bung well and the upper edge of the outer downward-pointing U-shaped rim of the barrel lid, whereby the radial extensions or surface lengths of the said area or segment of the barrel lid are elongated in relation to the adjoining areas or segments of the barrel lid. As a beneficial result, this previously critical area of the barrel lid around the bung well will no longer display the traditionally extreme stress peaks. The areas of the barrel lid in direct proximity to the bung well, i.e. in the transitional area between the recessed bung well and adjoining areas of the barrel lid, will no longer be the most likely location of leaks or cracks.

In an enhanced conceptual version of this invention, the base of the circular, perimetric gripping groove varies in depth, with the said groove base being deeper in the area or areas in front of the bung well or wells than in the circumferential areas away from the bung well, in such manner that, according to another characteristic feature of this invention, all of the radial extensions or surface lengths, in every radial direction of the barrel lid, are precisely identical as measured from the center of the lid to the upper edge of the rim of the lid.

This design step permits controlled compensation for divergences of the radial extensions in the lid areas around the bung wells. Given identical extensions, the lid areas around the bung wells will not be subjected to greater stress loads than the remaining lid areas, or at least significantly less so than without this compensating measure, and the rim of the lid will no longer slip out of the clamping ring, or indeed break, more readily in the area of the bung wells, as has traditionally been the case in the previously critical lid areas around the bung well.

In another preferred design implementation of this invention, the barrel lid displays greater radial extensions or surface lengths, measured in the radial direction, in the areas around or in front of the bung well(s) than in the areas away from the bung wells. This permits further significant reduction of the stress peaks in the relatively stiff area around the bung well(s) and the clustering of stress peaks will now take place in the comparatively uncritical lid areas away from the bung well, i.e. offset by 90° in relation thereto.

In a further enhancement according to this invention, the transition from the normal, uniform base depth of the circular groove away from the areas in front of the bung well(s) to the greater depth of the groove base occurs directly in front of the bung well(s) via a flat grade or a sloped adapter piece which, in the circumferential direction, extends over a length of perhaps between 20 mm and 80 mm, and preferably 60 mm. By the same token, the transition from the greater depth of the groove base directly in front of the bung well(s) to the regular i.e. shallowest depth of the groove base in the lid-segment areas offset by 90° relative to the bung well(s), can be configured to be continuous, and preferably uniformly gradual. In any event, it will be desirable for the deeper groove base to extend, in the circumferential direction, perhaps exactly as far as the bottom of the bung well concerned (meaning the bung enclosure) is wide. The difference in depth of the groove base between the deeper section and that of regular depth in the case of a larger lidded barrel with a capacity of about 55 gal. (220 liters) and a barrel-lid diameter of about 560 mm should be between about 5 mm and 15 mm, and preferably about 7 mm. In the case of a smaller barrel with a capacity of about 36 gal. (120 liters) and a lid diameter of about 460 mm, the difference in depth between the deep section of the groove base and the regular groove base should be between about 2 mm and 12 mm, and preferably about 6 mm. The radial extension in that area will be elongated by twice the depth differential.

In another preferred design enhancement according to this invention, the barrel lid is provided in the outer rim area of the flat lid plate with a second fully or partly perimetric groove serving as an elasticity-enhancing expansion channel. The presence of this second groove further improves the flexibility and resilience of the barrel lid in both the radial and axial direction especially in an internal pressure test.

In a further refinement of this invention, the radial extensions of the barrel-lid segment areas in front of or around the bung well(s) as well as the barrel-lid segments away from the bung-well areas are preselectable by a defined degree of steepness, i.e. angle of inclination, of the conical or rounded circular sections of the side wall of the groove or grooves. Predetermination of the radial extensions is made possible by suitably varying the angle of inclination of the side walls of the groove or grooves. A steeper slope will elongate, i.e. increase, the radial extension. Since the second circular groove, i.e. the expansion channel, is interrupted by the bung well(s), providing a deeper groove base or steeper slope of the groove sides will in this case be particularly effective in preestablishing the radial extensions.

In a design variation, the deeper groove base and/or steeper groove sides may be limited exclusively to the outer gripping groove having a larger diameter. In another variation, the deeper base and/or steeper sides of the groove may be provided in both the outer gripping groove and in the second groove (expansion channel) of a smaller diameter in suitably matched form. The better approach in each case may be determined for instance as a function of the diameter of the barrel lid, or of the lid material (such as PE/HDPE, sheet iron or the like), or of the size and shape of the bung well (i.e. bung enclosure). In accordance with one desirable design version according to this invention, the transition from the deepest groove base directly in front of the bung well to the shallowest groove base in the lid-segment areas offset by 90° from the bung well may also be continuous and gradual. Specific selection of the radial extensions is advantageously implemented in the case of a liquid-impermeable thermoplastic barrel lid in which the gripping groove has a width (i.e. radial dimension) of between 8 mm and 25 mm, and preferably about 15 mm, and on the underside of the barrel lid the external transition from the groove base to the conical or rounded, inclined ring section (i.e. the inside of the inverted U-shaped rim of the lid) connects to an axially extending (i.e. cylindrical) circular element.

BRIEF DESCRIPTION OF THE DRAWINGS

The following describes and explains this invention in more detail with the aid of design examples schematically illustrated in the attached diagrams in which.

DETAILED DESCRIPTION OF THE INVENTION

Figure 1:
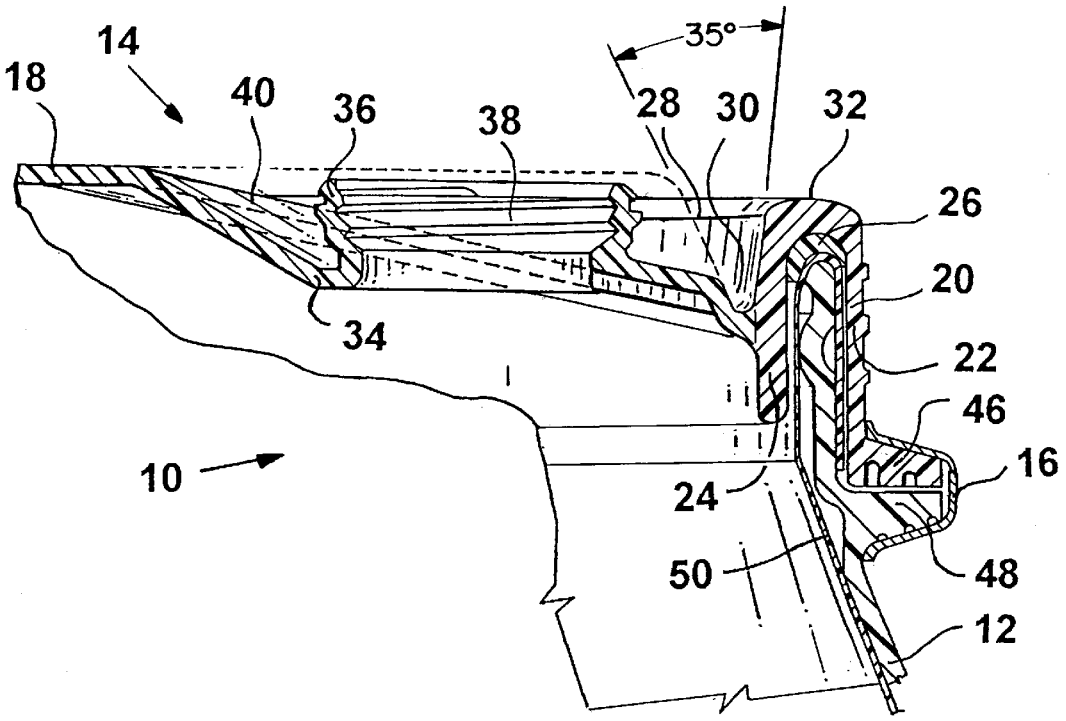
FIG. 1 is a partial, sectional view of the upper right end of a lidded barrel according to this invention, with a perimetric i.e. circular groove in the rim of the barrel lid.

In FIG. 1, the number 10 refers to a lidded barrel according to this invention, with a barrel body 12, a mounted barrel lid 14 and a clamping ring 16. The barrel lid 14 incorporates a central, flat lid plate 18 and a U-shaped lid rim 20 opening up toward the bottom, with an outer circular element 22 and an inner circular element 24. The U-shaped rim 20 holds a circular gasket 26 which, when the clamping ring 16 is tightened, seals the barrel lid 14 in gas- and liquid-impermeable fashion against the upper mouth edge of the barrel-body opening. The central lid plate 18 is connected, via a downward-tapered circular element 28, to the inner circular element 24 of the U-shaped rim 20 in such fashion that between the tapered or rounded circular element 28 and the inner circular element 24 of the U-shaped rim, partly extending into the opening of the barrel body, a circular gripping groove 30 is created. In the regular areas of the lid (away from the bung wells and away from the residue-draining slope), the gripping groove 30, roughly wedge-shaped in this case, should have a depth of not less than 15 mm as measured from the groove base to the upper edge 32 of the U-shaped rim 20. To provide internal support pressure for stacking purposes, the central, flat lid plate 18 protrudes by about 6 to 12 mm beyond the upper edge 32 of the rim of the lid. The peripheral area of the flat lid plate 18 incorporates a recessed bung well 34 with a projecting bung spout 36 and a bunghole 38. The upper leg of the clamping ring 16 reaches around a radially projecting rim flange 46 of the lid, located at the bottom edge of the outer circular element 22 of the lid rim 20, while its lower leg reaches around a casing flange 48 positioned on the outside wall of the barrel body 12 at a distance of about 40 mm below the barrel opening, pressing the barrel lid 10 against the barrel opening in gas-and liquid-impermeable fashion. This method of attaching the barrel lid using a clamping ring in a lower position corresponds to the barrel lid developed by Mauser in 1975 for the globally known and employed "standard lidded barrel". In the case at hand, the lidded barrel 10 is provided with an inserted, thin-walled Inliner 50 (foil liner).

Figure 2:
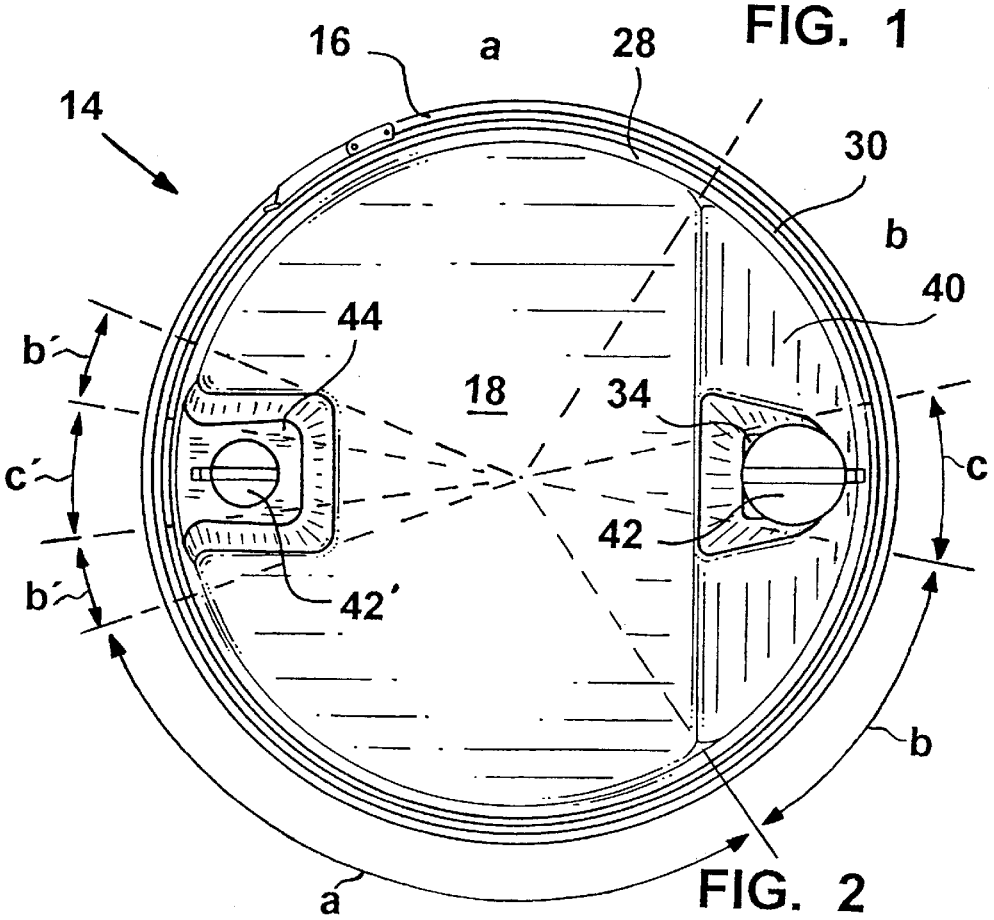
FIG. 2 is a top view of the lidded barrel per FIG. 1.
Figure 3:
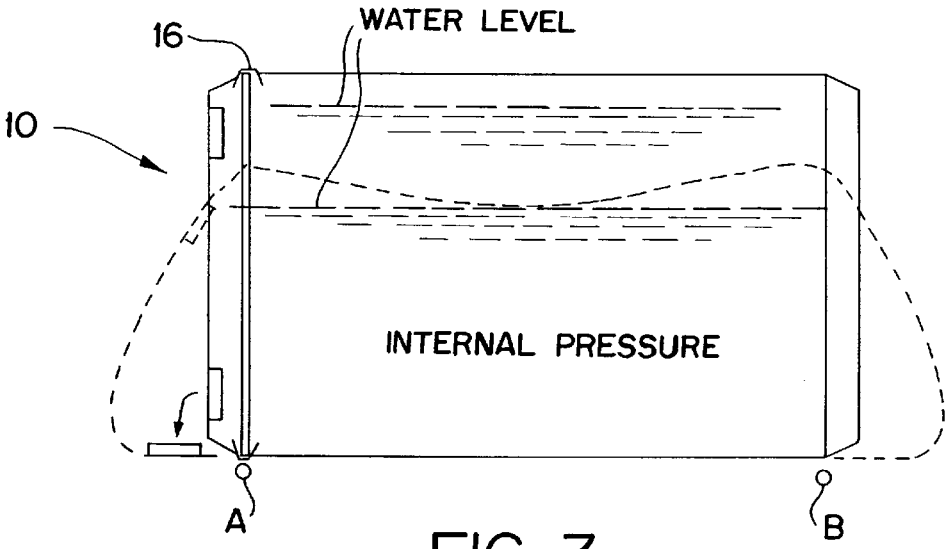
FIG. 3 PRIOR ART
FIG. 3 is a schematic lateral view of a conventional thermoplastic lidded barrel at the moment of a lateral impact (dropped sideways) on the ground.
Figure 4:
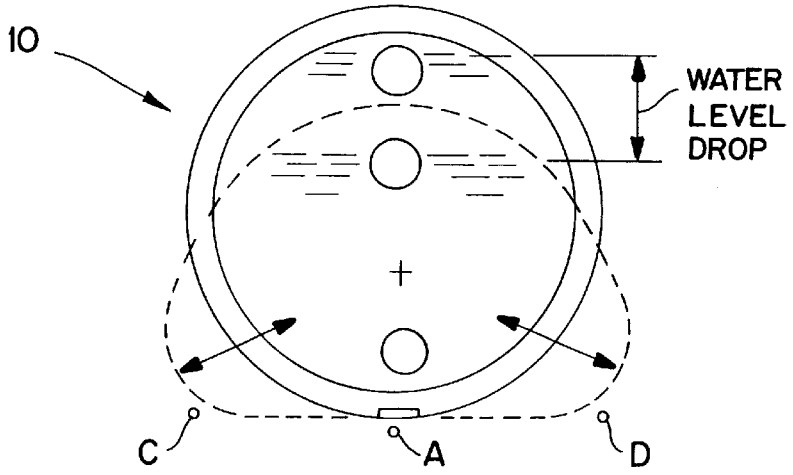
FIG. 4 PRIOR ART
FIG. 4 is a front view of the conventional thermoplastic barrel per FIG. 3 at the moment of the said lateral impact on the ground.

As is more clearly shown in FIG. 2, the flat lid plate 18 is provided near the bung well 34 with a symmetric plane or slope 40 for easiest possible draining of residual material from the lidded barrel in slightly tilted upside-down position. In this case, a stopcock is screwed into the 2" bunghole spout and, covering both, a seal-off cap 42 is snapped on. On the opposite side of the barrel lid 14, likewise recessed into a bung well 44, is a second smaller ¾" bunghole, itself covered by a seal-off cap 42'. According to this invention, the groove base of the gripping groove 30 is deeper in the area in front of the bung wells 34, 44 than in the neighboring areas away from the bung wells 34, 44 outside the slope 40. Several barrel-lid segments are marked to show this more clearly. The lid segments a, b and b' are symmetrical. The lid segments c and c' directly in front of the bung wells 34, 44 are of different circumferential lengths corresponding to the width of the bung well 34 and 44, respectively, and their groove base is deeper. The lid segments a, by contrast, define the area with a regular depth of the groove base while the segment areas b and b' define the transitional sections from the regular depth to the greater depths of the groove base in front of the bung wells. To explain the deformation process in the case of lateral impact (i.e. when dropped sideways), FIG. 3 illustrates in a schematic lateral view a lidded barrel, where the solid lines indicate the normal contour and the dashed lines indicate the maximum-deformation condition at the moment of impact on the ground. FIG. 4 is a front view of the lidded barrel. The points critical for the liquid-impermeable integrity and unity of the barrel body, barrel lid and clamping ring are marked A (FIG. 3), C and D (FIG. 4). The largest axial deformation of the lid occurs in the area of point A. The flattening along C-A-D produces strong radial inward tensile stress in the exterior areas C and D. In these two areas, the barrel body, i.e. the rim of the barrel body to which the lid is attached by means of the clamping ring, also wants to expand strongly in a radial direction; this, too, creates strong outward tensile stress at the rim of the barrel body. Due to the maximum bending force on the lid superimposed at this point and the high tensile stress patterns working in the opposite principal directions it follows virtually as a matter of course that in the case of overstress it is first and foremost at a point like this that the barrel lid comes off, i.e. the outer rim of the lid slips out of the upper leg of the clamping ring.

In a diagonal drop, i.e. the oblique impact of the lid rim and clamping ring on the ground, the main stress on the lid is in the area 180° from the point of impact due to the overlaying of radial and axial tensile stress forces, in that the barrel body and lid are abruptly stopped in their movement while the contents of the barrel want to continue moving in the direction of the drop (surge pressure). At that point the lid will buckle strongly in the axial direction, reducing its diameter and causing its rim to be pulled out from under the upper part, or leg, of the clamping ring.

The elasticity of a barrel lid can be improved by providing an additional circular expansion groove in the perimeter area of the central lid plate, elongating the radial extensions; however, this enhancement of the radial extensions must exclude the bung areas so that these areas, having shorter radial extensions while being more rigid by virtue of the bung-spout material, are the trouble spots in the case of extreme bending stress.

The measures provided by this invention permit a precise selection of the radial extensions in the barrel lid. On the one hand, identical radial extensions may be selected throughout so as to truncate stress peaks and obtain a specific stress relief in the areas of the bung enclosures; on the other hand, intentionally nonuniform radial extensions can be selected so that for the lid segments c and c', incorporating the bung enclosures, longer radial extensions are present than for instance in the lid segments a, offset by 90°, in such fashion that the highest stress loads are shifted into these uncritical, highly elastic lid areas.

Figure 5:
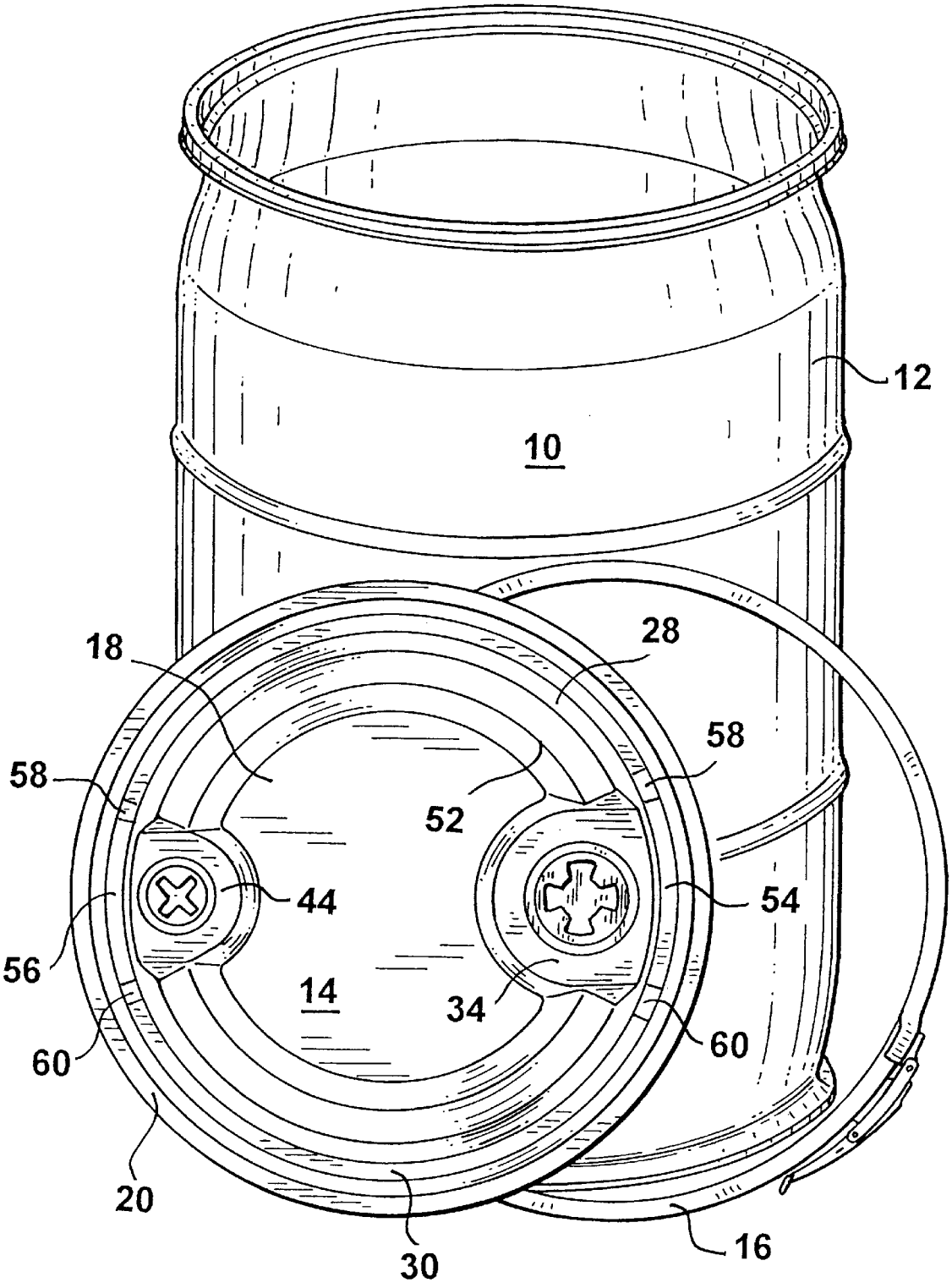
FIG. 5 is a perspective view of another lidded barrel according to this invention, showing next to it the detached barrel lid and the clamping ring.

FIG. 5 shows another lidded barrel 10 with the barrel lid 14 and clamping ring 16 detached. The barrel body 12 is equipped in its central cylindrical area with two protruding rolling hoops and at the transition between its side wall and the barrel bottom with a massive, perimetric bottom-rolling hoop. Directly behind its rim 20, the barrel lid 14 features the circular gripping groove 30, and near the perimeter of the flat central lid plate 18 another circular expansion groove 52 with a V-shaped cross section. This expansion groove 52 is interrupted only by the two mutually opposite, peripheral bung wells 34, 44. In the area of these two bung wells 34, 44 the outer gripping groove 30 is deeper than in the other rim areas away from the bung wells. The lower-lying sections 54, 56 (segments c, c') with the adjoining sloped sections 58, 60 (segments b, b') transitioning to the higher groove base level (segment a) are clearly discernible.

Figure 6:
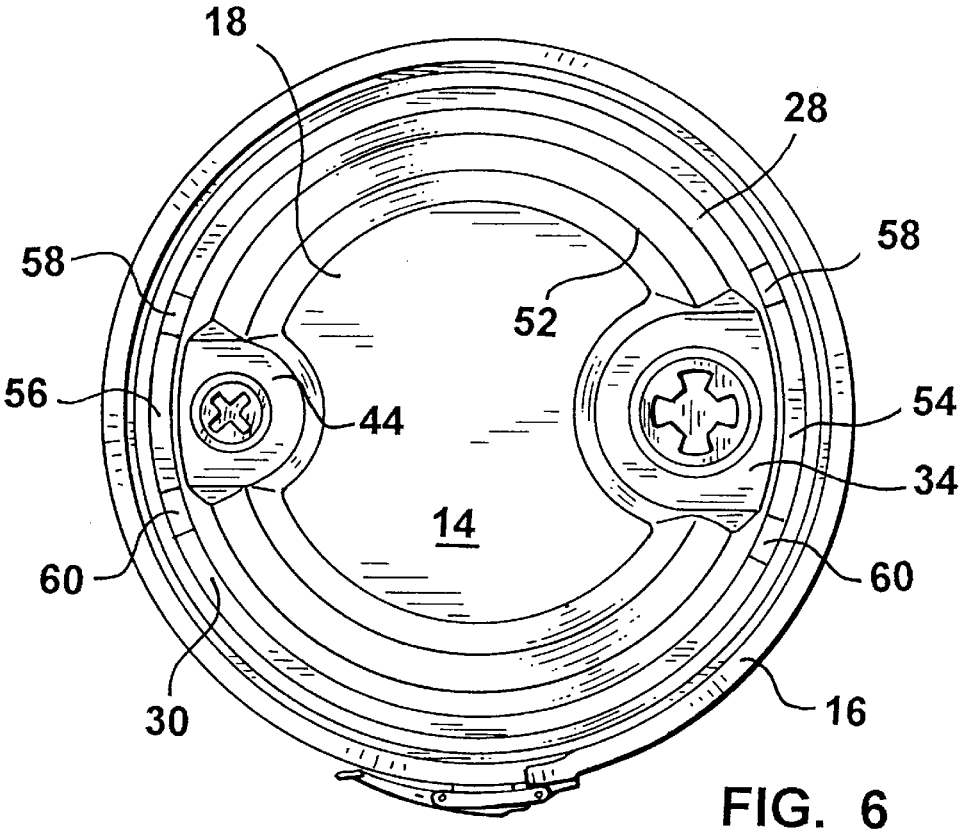
FIG. 6 is a top view of the barrel lid with clamping ring per FIG. 5.
Figure 7:
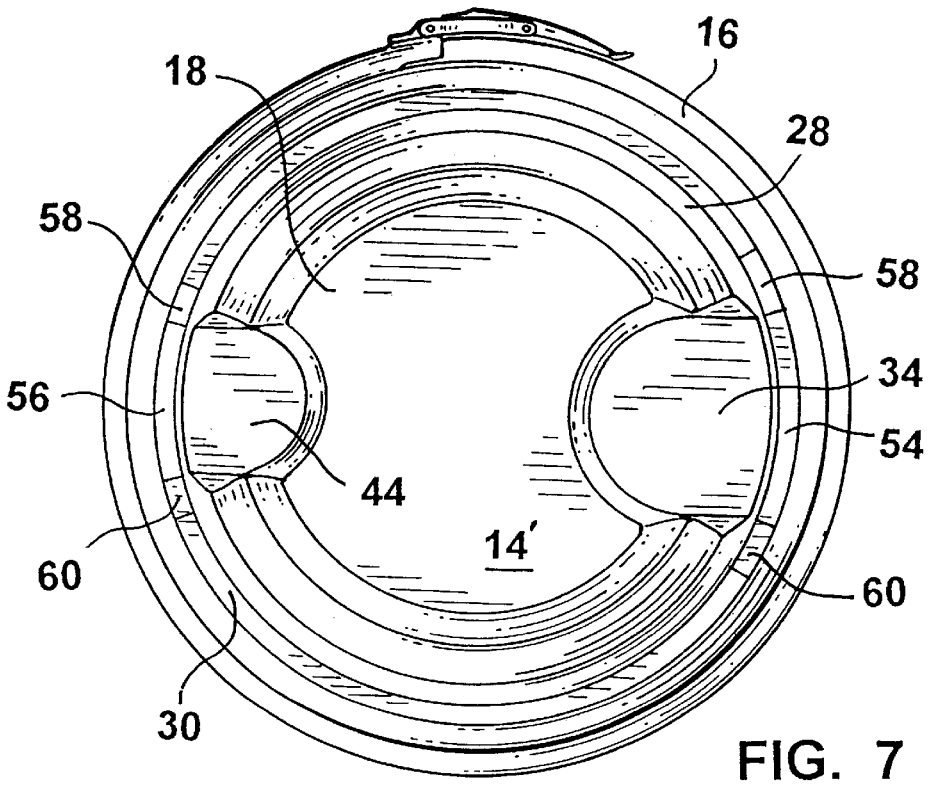
FIG. 7 shows a modified barrel lid with bung wells but without bung openings.

FIG. 6 is a top view of the barrel lid design per FIG. 5, with the clamping ring 16 mounted. FIG. 7 shows a similar barrel lid 14' with circular gripping groove 30 and circular expansion groove 52 incorporating the bung wells 34, 44, albeit without the bung spouts and bungholes. Here as well, the concept of a deeper groove base in the gripping groove in front of the bung wells is implemented. For instance, if customers want a lid without bunghole, as shown in FIG. 7, such a lid can be produced in the same injection mold as the lid per FIG. 6. One simply mounts two corresponding blanks or dummy inserts in the mold. No second, expensive injection mold for lids without a bunghole is necessary.

For simplicity's sake, the following additional barrel-lid design examples will use the same reference numbers where the components are identical.

Figure 8:
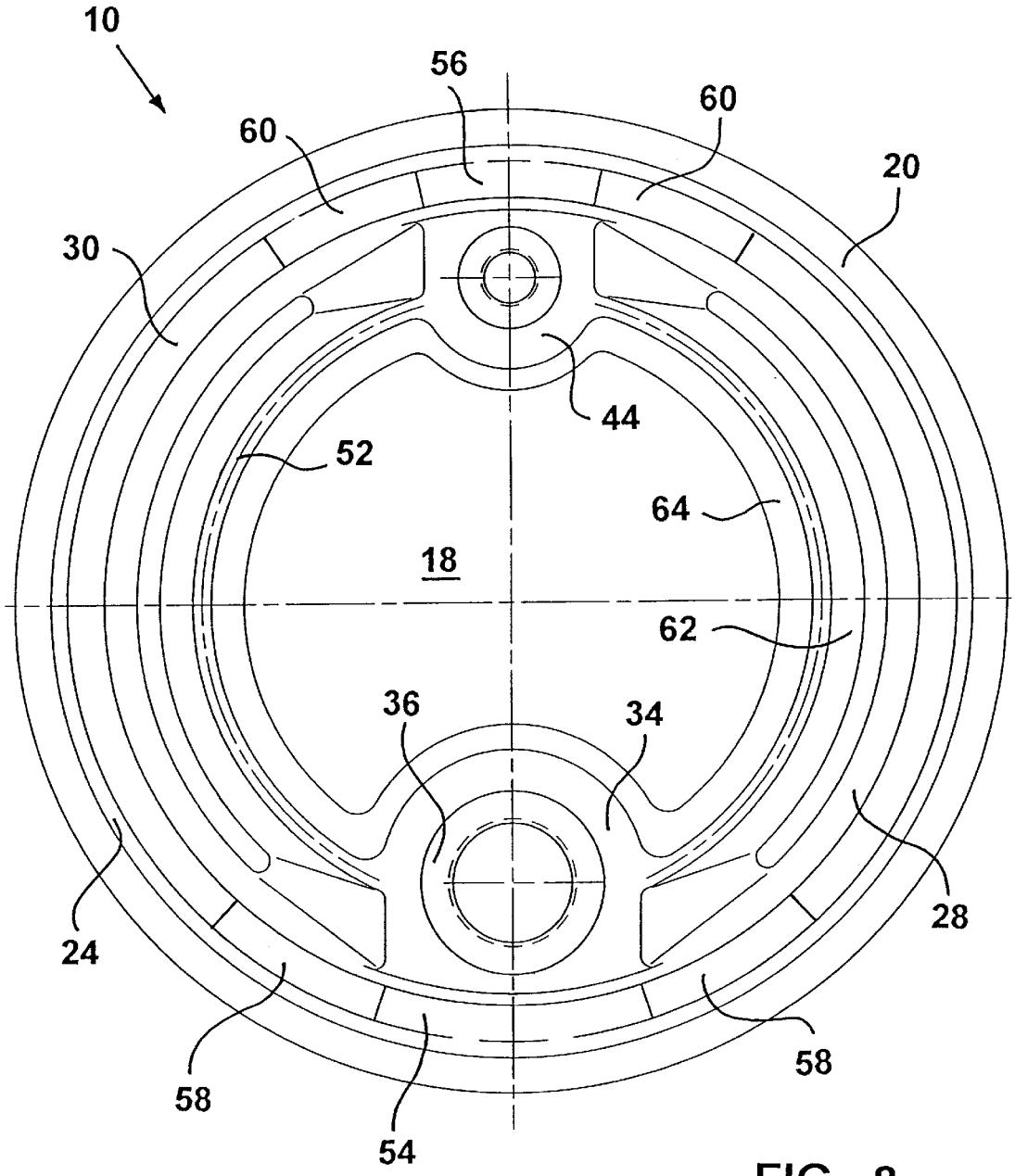
FIG. 8 is a top view of another barrel lid according to this invention.

FIG. 8 illustrates a liquid-impermeable barrel lid 10 which, in a special design version, is provided with a flat groove base, about 16 mm wide, in the outer circular gripping groove 30. Connecting to the inverted U-shaped rim 20, with a short outer leg (i.e. circular element 22, FIG. 1) and an inner leg (circular element 24) which in this design version is stepped or configured as a shoulder, is the shallow groove base of the gripping groove 30. From the groove base, the inner side wall of the gripping groove 30 rises as a tapered or rounded circular element 28 up to the level of the central flat lid plate 18. The angle of inclination of this sloped side wall is about 55°. For a precise selection of the radial extensions in the various lid segments the angle of inclination of the conical or obliquely rounded circular elements (i.e. side walls of the grooves) may be varied, i.e. preselected, in the range between 30° and 70°. Located in the peripheral area of the raised central lid plate 18 are the two diametrically opposite bung wells 34, 44. The recessed bung well 34 incorporates the protruding bung spout 36 with the 2" bunghole while the smaller bung well 44 incorporates the smaller bung spout with a 3/4" bunghole. Also located in the peripheral area of the central lid plate 18 is the second partially circular groove 52 serving as a V-shaped expansion groove the circular path of which is interrupted by the bung wells 34 and 44 while its groove base transitions flush into the bottom plane of these two bung wells. The outer, obliquely conical or rounded side wall of the expansion groove 52 bears the reference number 62, its inner side wall the number 64. The angle of inclination of both sidewalls 62 and 64 is about 45°, resulting in an opening angle of about 90° for the expansion groove 52. Of course, depending on the desired radial extension, these angles of inclination may be varied and adapted as necessary. For example, a sidewall may rise at a varying slope, with continuous, gradual transitions between the different slope angles. As can be seen in FIG. 8, an essentially V-shaped circular element 66 (i.e. a ridge), open toward the lid underside, rises between the two grooves 30 and 52, its outer boundary constituted by the inner conical sidewall of the gripping groove 30 and its inner boundary by the outer conical sidewall of the expansion groove 52. It can also be seen that both sides of the lower-lying section 54 of the gripping groove in front of the bung well 34 bound on the sloped connecting sections 58, and both sides of the lower-lying section 56 in front of the bung well 44 bound on the sloped connecting sections 60 to transition to the regular, i.e. higher, level of the groove base of the gripping groove.

Figure 9:
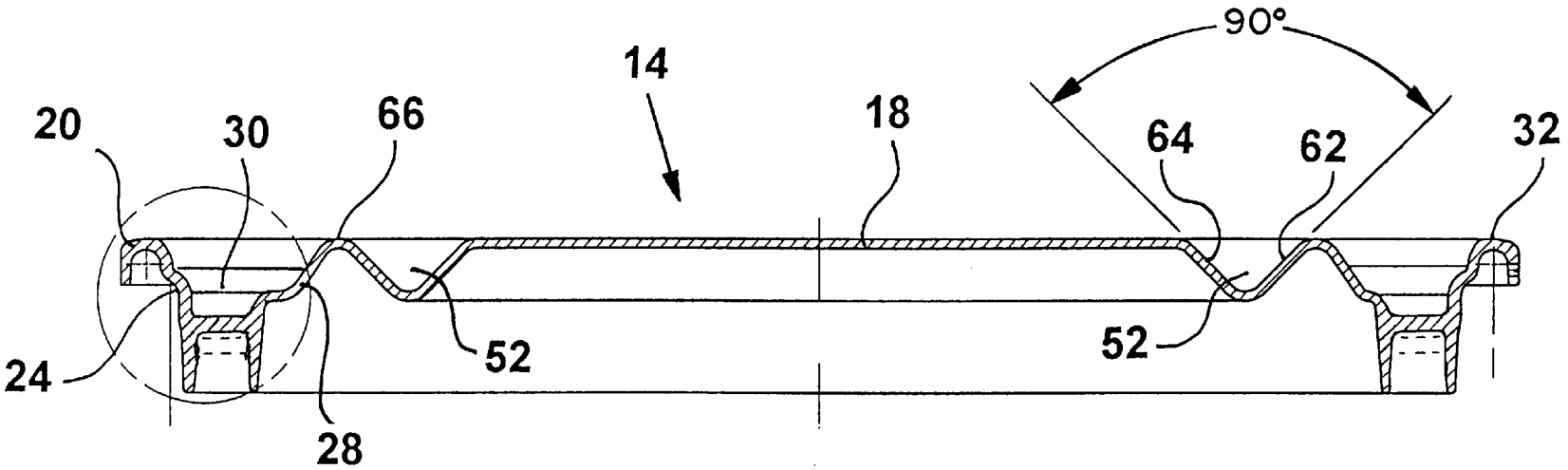
FIG. 9 shows a cross section of the barrel lid per FIG. 8 away from the bung wells.

FIG. 9 is a cross-sectional view of the barrel lid per FIG. 8 in an area away from the bung wells such as a lid area offset by 90° relative to the bung wells. The outer area of the central lid plate 18 is provided with the V-shaped expansion groove 52 having an opening angle of about 90°. Between the expansion groove 52 and the gripping groove 30 there is once again the inverted V-shaped circular element 66 (ridge) opening towards the bottom. In this case, the regular-depth, shallow gripping groove, represented by a solid line, has a width or radial dimension of 15 mm.

For comparison, the dashed line indicates the deeper groove base in the offset area in front of the bung wells. The special feature of this design version, as can be seen, is that the inner circular element 24 of the U-shaped rim 20 is slightly angled at first (curved somewhat like an S) and is then axially elongated in such fashion that, when the lid is mounted on the mouth of the barrel, it extends into the said mouth of the barrel by between about 25 mm and 55 mm, and preferably about 35 mm, as measured from the bottom edge of the outer circular element 22 of the U-shaped rim 20. As seen from the underside of the barrel lid, this elongation is in the form of a cylindrical circular element 68 which in the external transitional area extends axially from the groove base to the tapered or rounded, rising circular element 24 (i.e. the inner leg of the inverted U-shaped rim of the lid). Likewise, a second (cylindrical) circular element 70 extends axially in the inner transitional area from the groove base to the internally conical or rounded, rising circular element (i.e. the circular element connecting to the central lid plate 18 and the expansion groove 52, respectively). The lid area between the U-shaped rim 20 and the circular element or ridge 66 or, respectively, the central lid plate 18 thus takes on the cross-sectional shape of an H. This structural shape is extremely deformation-resistant especially in terms of hydraulic internal pressure and in drop tests. Remaining dents, for instance after the barrel was dropped, are largely absorbed by the inner circular element 70 or occur in the latter, thus leaving no remaining deformations in the outer circular element 68, so that the lidded barrel will not spring a leak. The axial dimension of the circular elements 68, 70, as measured from the bottom of the groove base, is between 8 mm and 30 mm, and preferably about 14 mm.

Figure 10:
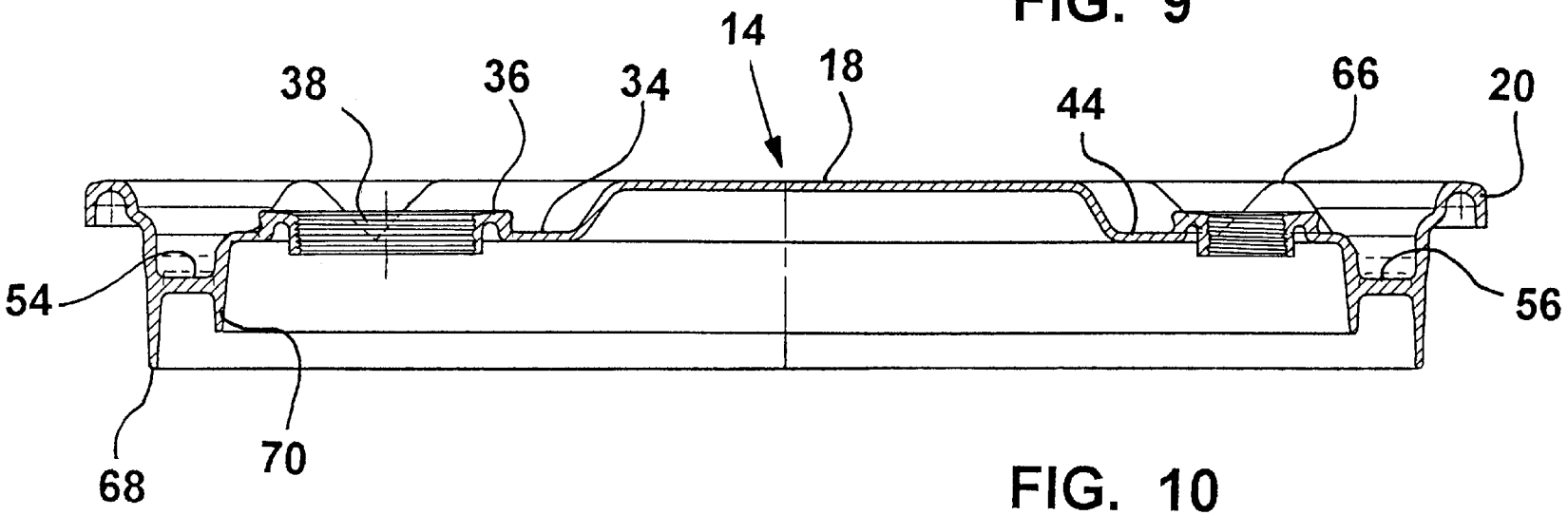
FIG. 10 shows a cross section of the barrel lid per FIG. 8 through both bung wells.

FIG. 10 is a cross-sectional view through the bung areas of a slightly modified lid 14. It shows, in solid lines, the deeper groove base of the gripping groove 30 in front of the bung wells 34 and 44; the regular, shallower groove base of the gripping groove away from the bung areas is indicated, for comparison, by a dashed line. The axial dimension of the outer circular element 68 is larger in this design variation than the axial dimension of the inner circular element 70. The axial dimension of the outer circular element 68 should be between 8 mm and 30 mm, and preferably about 18 mm, while the axial dimension of the inner circular element 70 should be between 8 mm and 20 mm, and preferably about 12 mm. In typical barrel lids with peripheral bung spouts, the bottom plane of the bung well is generally at the same level as (i.e. flush with) the groove base of the circular gripping groove. one of the major features of the barrel lid according to this invention is that th e groove base of the gripping groove in front of the bung well is in any event deeper still, by about 10 mm to 14 mm and preferably about 12 mm, than the bottom plane of the bung well (meaning a stepped transition from the bung w ell to the groove base).

Figure 11:
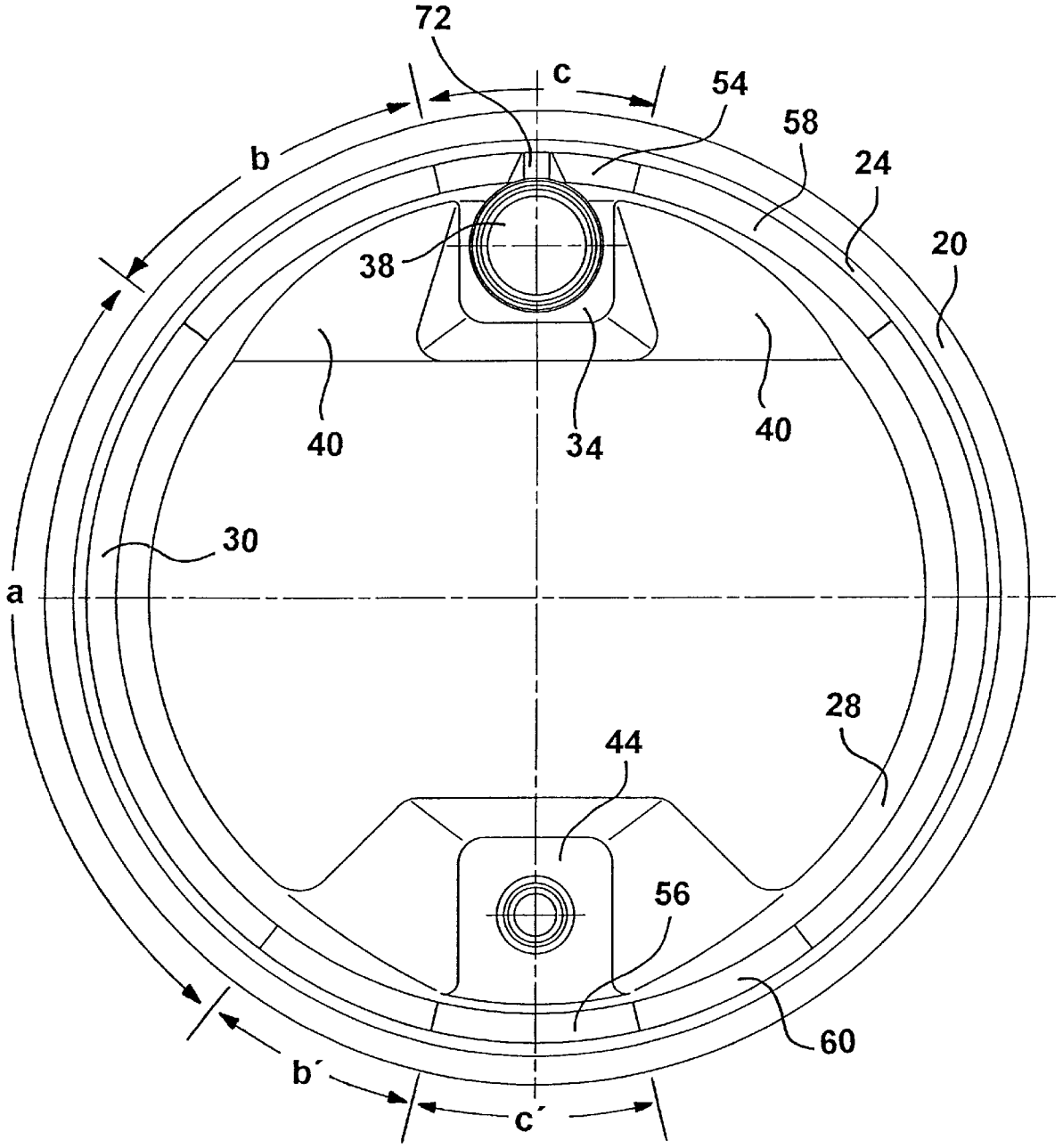
FIG. 11 is a top view of another barrel lid according to this invention.
Figures 12, 13, 14:
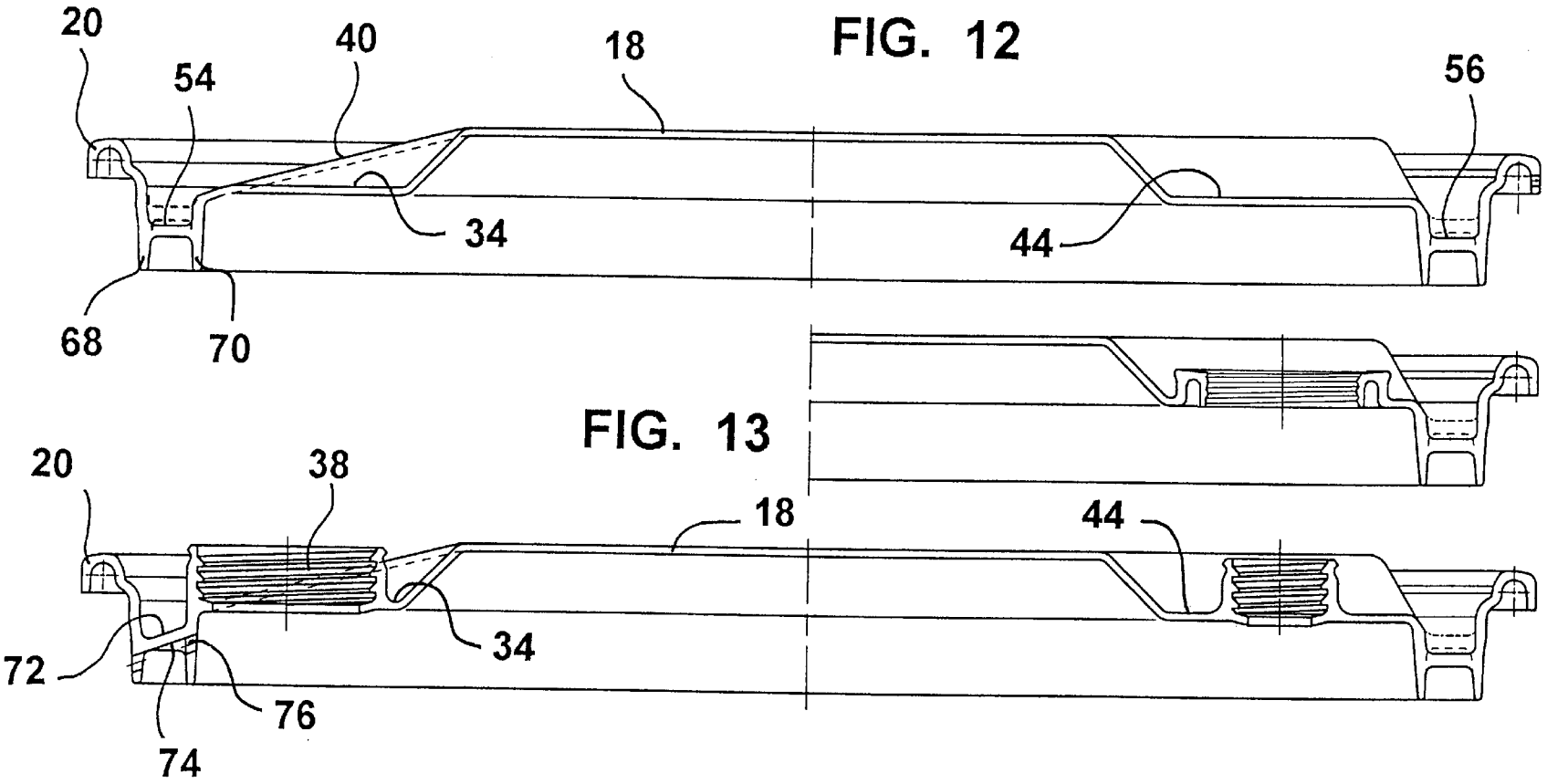
FIG. 12 shows a cross section of another, modified barrel lid.
FIG. 13 shows a partial cross section of another, modified barrel lid.
FIG. 14 shows a cross section of the barrel lid per FIG. 11 through both bung wells.

FIG. 11 is a top view of another design version of a barrel lid according to this invention. In this case, the bung well 44 with the smaller ¾" bunghole is particularly wide. This will also produce particularly long transitional sections or sloped connecting sections 60 (segment areas b') on both sides of the lower-lying section 56 of the gripping groove 30 in front of the bung well 44. The sloped connecting sections 58 (segment areas b) on both sides of the lower-lying section 54 in front of the bung well 34 with the 2" bunghole 38 are still somewhat longer, but that is because the 2" bung is configured as a residual drain bung for which purpose an appropriate slope 40 is provided on both sides of the bung well in the peripheral area of the central lid plate 18. In order to assure nearly complete residual draining of the lidded barrel in a slightly inclined upside-down position, preventing residual liquid from being retained on the lid underside behind or between the circular, cylindrical elements 68, 70, a centered, radially extending drain gutter 74 is provided in front of the 2" drain bung within the gripping groove 30. On the top surface of the lid, this drain gutter appears as a ridge 72 rising obliquely toward the center of the lid, while on the outside it runs flush into the lower-lying section 54 and on the inside it rises to the level of the regular groove base (away from the bung area). In addition, at certain points within the course of the gutter, sloped passages 76 (holes) are provided in the two cylindrical circular elements 68, 70 (FIG. 12). This will allow the very last residue of the liquid that may have collected behind these circular elements to exit via the drain bung by themselves. The drain gutter 72/74 with the holes 76 can also be seen in the cross-sectional illustration of the barrel lid (per FIG. 11) in FIG. 14. The same barrel lid is depicted in FIG. 13. The only difference here is that in lieu of the ¾" bung a fine-pitch threaded 2" bung (US version) is used.

FIG. 12 shows the same barrel lid minus the bung spouts and bungholes. For its production, the tools for the various bung spouts are simply replaced in the injection mold with appropriate dummy blanks. It is a matter of course that the individual features described here and illustrated in the diagrams can be mutually interchanged and combined in any way.

According to the invention here described, a deepening of the groove in the lid-segment areas c, c' in front of the bung wells and/or a flatter or steeper sloping of the groove sidewalls in the segment areas away from the bung wells thus allows for the radial extensions or surface lengths of the barrel lid to be somewhat shorter in the areas away from the bung enclosure than in the areas in front of the bung wells. This is a simple way to specifically shift the stress peaks into uncritical, more elastic areas of the lid away from the stiff bung-well areas, whereby, when a barrel is dropped or the internal pressure is significantly increased, the lidded barrel according to this invention is substantially more leak-proof, making it superbly suitable for use with liquid products and admissible even for certain hazardous substances.

While conventional lidded barrels filled with liquid typically start leaking, and the lid even comes off in many cases, when the barrel is dropped from a height of as little as 1.2 m, the lidded barrel according to this invention remains absolutely leakproof even when dropped from a height of up to 1.4 m.

| List of Reference Numbers | |
|---|---|
| 10 | Lidded barrel |
| 12 | Barrel body |
| 14 | Barrel lid |
| 16 | Clamping ring |
| 18 | Central flat lid plate |
| 20 | U-shaped rim of lid |
| 22 | Outer circular element (20) |
| 24 | Inner circular element (20) |
| 26 | Gasket (14) |
| 28 | Sloped conical circular element |
| 30 | Gripping groove (20/28) |
| 32 | Upper facing edge (20) |
| 34 | Bung well |
| 36 | Bung spout |
| 38 | Bunghole |
| 40 | Residual-drain slope (18) |
| 42 | Seal-off cap |
| 44 | Bung well |
| 46 | Flanged rim on lid |
| 48 | Casing flange |
| 50 | Inliner |
| 52 | V-shaped expansion groove |
| 54 | Lower-lying section (30, 34) |
| 56 | Lower-lying section (30, 44) |
| 58 | Sloped connecting section (30, 54) |
| 60 | Sloped connecting section (30, 56) |
| 62 | Outer side wall (52) |
| 64 | Inner side wall (52) |
| 66 | Circular element - ridge section (52/30) |
| 68 | Outer cylindrical circular element |
| 70 | Inner cyl. circular element |
| 72 | Drain gutter (outer ridge) |
| 74 | Drain gutter (inner channel) |
| 76 | Pass-through hole |
| 78 | 2" bung (US version) |

I claim:

1. In a lidded barrel (10) for storing and transporting hazardous liquid or solid bulk materials, the barrel having a barrel body (12) with an outer barrel wall and an upper barrel opening; an upper barrel lid (14) having a center, an outer inverted U-shaped rim (20) with an upper edge (32) and a plurality of radial surface lengths extending radially from said center to the upper edge of the U-shaped rim (20) of said lid; and a U-shaped clamping-ring closure (16) which hooks under a flanged rim (48) provided on the outer barrel wall in the area of the upper barrel opening while clamping over the outer U-shaped rim (20) of the barrel lid (14) and, when in a closed position, pressing the said lid against the barrel opening for a closure impermeable to gas and liquids; the said barrel lid (14) having at least one recessed bung well (34, 44) recessed in the periphery of a central lid plate (18), and a first circular gripping groove (30) disposed between the central flat lid plate (18) and the rim (20) of the lid, the improvement comprising:

a radial surface length extending through a region in front of said at least one recessed bung well (34, 44) is at least as long as radial surface length in lid regions disposed circumferentially away from said at least one bung well (34, 44).

2. Lidded barrel as in claim 1, wherein:

the radial surface length in said region in front of said at least one bung well (34, 44) and in said regions circumferentially away from said at least one bung well (34, 44) are substantially equal.

3. Lidded barrel as in claim 1, wherein:

the radial surface length in said region in front of said at least one bung well (34, 44) is greater than the radial surface length in said regions circumferentially away from said at least one bung well (34, 44).

4. Lidded barrel as in claim 1, wherein:

a second, at least partly continuous groove (52) is disposed in the periphery of the flat lid plate (18) between the center of the lid and the first circular gripping groove (30) and defines an expansion channel.

5. Lidded barrel as in claim 4, wherein:

a) the first circular gripping groove and the second groove each include conical or rounded circular elements defining the side walls; and b) the radial surface length in the region in front of said at least one bung well (34, 44) and the radial surface length in the regions circumferentially away from said at least one bung well differ from each other due to differences in steepness or angle of inclination of the conical or rounded circular elements constituting the side walls.

6. Lidded barrel as in claim 5, wherein:

the differences of the angle of inclination of the groove side walls is limited to the first circular gripping groove (30).

7. Lidded barrel as in claim 5, wherein:

the differences of the angle of inclination of the groove side walls is included in both the first circular gripping groove (30) and the second groove (52).

8. Lidded barrel as in claim 1, wherein:

the first circular gripping groove (30) extends circumferentially around the lid and includes a first groove base (54, 56) in the region in front of said at least one bung well (34, 44) having a first depth and a second groove base in the regions circumferentially away from said at least one bung well (34, 44) having a second depth, wherein said first depth is at least as great as said second depth.

9. Lidded barrel as in claim 8, wherein:

a) the first and second groove bases of the first circular gripping groove (30) each have a width extending between an inner groove periphery and an outer groove periphery, as measured in the radial direction relative to the center of the lid, of between 8 mm and 25 mm;

b) the barrel lid (14) has an underside with an outer circular element (68) disposed along said outer groove periphery and extending axially away from said first and second groove bases.

10. Lidded barrel as in claim 9, wherein:

the underside of the lid has a inner circular element (70) disposed along said inner groove periphery and extending axially away from said first and second groove bases.

11. Lidded barrel as in claim 10, wherein:

the inner and outer circular elements (68, 70) extend axially, as measured from the groove base, between 8 mm and 30 mm.

12. Lidded barrel as in claim 11, wherein:

the inner and outer circular elements (68, 70) extend axial about 14 mm.

13. Lidded barrel as in claim 10, wherein:

the outer circular element (68) extends further than the inner circular element (70).

14. Lidded barrel as in claim 13, wherein:

the outer circular element (68) extends between 8 mm and 30 mm, and the inner circular element (70) extends between 8 and 20 mm.

15. Lidded barrel as in claim 14, wherein:

the outer circular element (68) extends about 18 mm and the inner circular element extends about 12 mm.

16. In a lidded barrel (10) for storing and transporting hazardous liquid or solid bulk materials, the barrel having a barrel body (12) with an outer barrel wall and an upper barrel opening; an upper barrel lid (14) having a center, an outer inverted U-shaped rim (20) with an upper edge (32) and a plurality of radial surface lengths extending radially from said center to the upper edge of the U-shaped rim (20) of said lid; and a U-shaped clamping-ring closure (16) which hooks under a flanged rim (48) provided on the outer barrel wall in the area of the upper barrel opening while clamping over the outer U-shaped rim (20) of the barrel lid (14) and, when in a closed position, pressing the said lid against the barrel opening for a closure impermeable to gas and liquids; the said barrel lid (14) having at least one recessed bung well (34, 44) recessed in the periphery of a central lid plate (18), and a first circular gripping groove (30) disposed between the central flat lid plate (18) and the rim (20) of the lid, the improvement comprising:

a radial surface length extending through a region in front of said at least one recessed bung well (34, 44) is at least as long as the radial surface length in lid regions disposed circumferentially away from said at least one bung well (34,44);

the first circular gripping groove (30) extends circumferentially around the lid and includes a first groove base (54, 56) in the region in front of said at least one bung well (34, 44) having a first depth and a second groove base in the regions circumferentially away from said at least one bung well (34, 44) having a second depth , wherein the first depth is greater than said second depth.

17. Lidded barrel as in claim 16, wherein:

the lidded barrel has a capacity of about 55 gal. (220 L.), the barrel-lid has a diameter of about 560 mm, and the difference between the first depth and the second depth is between about 5 mm and 15 mm.

18. Lidded barrel as in claim 17, wherein:

said difference in depth is about 7 mm.

19. Lidded barrel as in claim 16, wherein:

the lidded barrel has a capacity of about 36 gal. or 120 liters, the barrel-lid has a diameter of about 460 mm, and the the difference between the first depth and the second depth is between about 2 mm and 12 mm.

20. Lidded barrel as claimed in claim 19, wherein:

said difference in depth is about 6 mm.

21. Lidded barrel as in claim 16, wherein:

the first groove base of the fit circular groove (30) in front of said at least one bung well (34, 44) is connected to the second groove base circumferentially away from said at least one bung well (34, 44) by a flat transitional sloped connecting section (58, 60).

22. Lidded barrel as in claim 21, wherein:

the transition from the first groove base in front of said at least one bung well (34, 44) to the second groove base in the regions spaced therefrom by 90° relative to said at least one bung well (34, 44) is continuous and along an even, gentle slope.

23. Lidded barrel as in claim 21, wherein:

the sloped connecting element (58, 60) extends in the circumferential direction over a length of about 20 mm to 80 mm.

24. Lidded barrel as in claim 23, wherein:

the sloped connecting element (58, 60) extends in the circumferential direction over a length of about 60 mm.

25. Lidded barrel as in claimed 23, wherein:

a) said at least one bung well (34, 44) has a circumferential width; and b) the first groove base (54, 56) extends in the circumferential direction over a distance about equal to the circumferential width of said at least one bung well (34, 44).

* * * * *

UNITED STATES PATENT AND TRADEMARK OFFICE
CERTIFICATE OF CORRECTION

PATENT NO. : 5,941,406

DATED : August 24, 1999

INVENTOR(S) : Dietmar PRZYTULLA

It is certified that errors appear in the above-identified patent and that said Letters Patent is hereby corrected as shown below:

Column 12, line 6, delete "the" (second occurrence).

Column 12, line 12, change "fit" to --first--.

Signed and Sealed this

Sixteenth Day of May, 2000

*Attest:*

*Attesting Officer*

Q. TODD DICKINSON

*Director of Patents and Trademarks*